US011686126B2

(12) United States Patent
Simon et al.

(10) Patent No.: US 11,686,126 B2
(45) Date of Patent: Jun. 27, 2023

(54) METHODS OF OPERATING A LOCK

(71) Applicant: Endura Products, LLC, Colfax, NC (US)

(72) Inventors: Stephen Simon, Winston-Salem, NC (US); Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 392 days.

(21) Appl. No.: 16/932,305

(22) Filed: Jul. 17, 2020

(65) Prior Publication Data

US 2021/0017791 A1 Jan. 21, 2021

Related U.S. Application Data

(60) Provisional application No. 62/875,704, filed on Jul. 18, 2019.

(51) Int. Cl.

| | |
|---|---|
| ***E05B 47/06*** | (2006.01) |
| ***E05C 7/04*** | (2006.01) |
| ***E05B 63/00*** | (2006.01) |
| ***G07C 9/00*** | (2020.01) |
| ***E05B 59/00*** | (2006.01) |

(Continued)

(52) U.S. Cl.

CPC ..... *E05B 47/0676* (2013.01); *E05B 59/00* (2013.01); *E05B 63/0065* (2013.01); *E05C 7/04* (2013.01); *G07C 9/00182* (2013.01); *G07C 9/00714* (2013.01); *G07C 9/00857* (2013.01); *G07C 9/27* (2020.01); *G07C 9/28* (2020.01);

(Continued)

(58) Field of Classification Search

CPC .. G07C 9/00182; G07C 9/00857; G07C 9/27; G07C 9/28; E05B 47/0676

See application file for complete search history.

(56) References Cited

U.S. PATENT DOCUMENTS

| | | | |
|---|---|---|---|
| 4,899,562 | A | 2/1990 | Gartner et al. |
| 4,926,664 | A | 5/1990 | Gartner et al. |

(Continued)

FOREIGN PATENT DOCUMENTS

| | | |
|---|---|---|
| AU | 2000053315 | 1/2001 |
| CA | 2650128 A1 | 10/2007 |

(Continued)

*Primary Examiner* — Nabil H Syed

(74) *Attorney, Agent, or Firm* — Womble Bond Dickinson (US) LLP

(57) ABSTRACT

A method of controlling a lock mechanism of an active door includes transiting an access controller of the lock mechanism to an authorized access mode and transitioning the access controller from the authorized access mode to an entry mode. Transitioning the access controller to the authorized access mode is in response to an authorized user being sensed approaching the active door from an exterior side of the active door or in response to input on a remote device. In the authorized access mode, an exterior handle of the active door is decoupled from a main latch of the lock mechanism. Transitioning the access controller to the entry mode is in response to sensed contact with the exterior handle. In the entry mode, the exterior handle is capable of rotating to transition the access controller to an unlocked mode in which the exterior handle is operably coupled to the main latch.

20 Claims, 3 Drawing Sheets

(51) Int. Cl.

| | |
|---|---|
| ***G07C 9/27*** | (2020.01) |
| ***G07C 9/28*** | (2020.01) |
| *E05C 9/00* | (2006.01) |
| *E05B 47/00* | (2006.01) |

(52) U.S. Cl.
CPC ..... *E05B 2047/0094* (2013.01); *E05B 2063/0082* (2013.01); *E05C 9/008* (2013.01)

(56) References Cited

U.S. PATENT DOCUMENTS

| | | | |
|---|---|---|---|
| 5,134,870 | A | 8/1992 | Uyeda et al. |
| 5,437,174 | A | 8/1995 | Aydin |
| 6,895,791 | B2 | 5/2005 | Alexander et al. |
| 7,051,561 | B2 | 5/2006 | Moon et al. |
| 7,222,508 | B2 | 5/2007 | Dickhans et al. |
| 7,918,117 | B2 | 4/2011 | Frolov et al. |
| 8,035,478 | B2 | 10/2011 | Lee |
| 8,353,189 | B2 | 1/2013 | Bogdanov et al. |
| 8,887,542 | B2 | 11/2014 | Bogdanov et al. |
| 9,097,037 | B2 | 8/2015 | McKibben et al. |
| 9,129,457 | B2 | 9/2015 | Sumcad et al. |
| 9,725,926 | B2 | 8/2017 | Carpenter et al. |
| 9,850,685 | B2 | 12/2017 | Dore Vasudevan et al. |
| 10,062,230 | B2 | 8/2018 | Ahearn et al. |
| 10,125,519 | B1 | 11/2018 | Gengler et al. |
| 10,132,104 | B2 | 11/2018 | Dore Vasudevan et al. |
| 10,171,974 | B2 | 1/2019 | Ahearn et al. |
| 10,192,372 | B2 | 1/2019 | Einberg |
| 10,233,672 | B2 | 3/2019 | McKibben et al. |
| 2005/0179267 | A1* | 8/2005 | Cote ..... E05B 47/0688 292/336.3 |
| 2006/0112747 | A1 | 6/2006 | Moon et al. |
| 2008/0127686 | A1 | 6/2008 | Hwang |
| 2013/0192317 | A1 | 8/2013 | McKibben et al. |
| 2014/0033773 | A1 | 2/2014 | Myers et al. |
| 2014/0145823 | A1 | 5/2014 | Aase |
| 2014/0165677 | A1* | 6/2014 | Hickman ..... E05B 47/0012 70/277 |
| 2015/0114055 | A1 | 4/2015 | Frolov et al. |
| 2015/0128667 | A1 | 5/2015 | Yoon et al. |
| 2015/0315816 | A1* | 11/2015 | Gopalakrishnan ..... E05B 63/06 70/344 |
| 2017/0167164 | A1 | 6/2017 | Baty et al. |
| 2017/0301166 | A1 | 10/2017 | Earles et al. |
| 2018/0051478 | A1 | 2/2018 | Tagtow et al. |
| 2018/0051480 | A1 | 2/2018 | Tagtow et al. |
| 2018/0155962 | A1 | 6/2018 | Mitchell et al. |
| 2018/0202194 | A1 | 7/2018 | Jaskiewicz et al. |
| 2018/0298642 | A1 | 10/2018 | Tagtow et al. |
| 2018/0313116 | A1 | 11/2018 | Criddle et al. |
| 2018/0328075 | A1 | 11/2018 | Coster et al. |
| 2019/0024437 | A1 | 1/2019 | Tagtow et al. |
| 2019/0040653 | A1 | 2/2019 | Baumgarte et al. |
| 2019/0051075 | A1 | 2/2019 | Ahearn et al. |

FOREIGN PATENT DOCUMENTS

| | | | |
|---|---|---|---|
| CA | 2833984 | A1 | 11/2012 |
| EP | 1617020 | A2 | 1/2006 |
| EP | 2441055 | A1 | 4/2012 |
| EP | 3349192 | A1 | 7/2018 |
| WO | 00/77330 | A1 | 12/2000 |
| WO | 2007/100167 | A1 | 9/2007 |
| WO | 2010/144449 | A1 | 12/2010 |
| WO | 2011/159921 | A1 | 12/2011 |
| WO | 2018/075605 | A1 | 4/2018 |
| WO | 2018/204147 | A1 | 11/2018 |
| WO | 2019/018901 | A1 | 1/2019 |

* cited by examiner

METHODS OF OPERATING A LOCK

CROSS-REFERENCE TO RELATED APPLICATION

This application claims priority to, and benefit of, U.S. Provisional Patent Application Ser. No. 62/875,704, filed Jul. 18, 2019. The entire contents of this application is hereby incorporated by reference.

BACKGROUND

1. Technical Field

The present disclosure relates to locks and, more specifically, to methods for operating or controlling a lock.

2. Discussion of Related Art

Builders have several options when designing entryways for homes or businesses. Typically, entryways either include a single hinged door or a set of double doors. If double doors are present, the two doors are typically arranged with the free, non-hinged edge of each door facing each other. An entryway may have double doors with an astragal positioned between the two doors. The door with the astragal can be referred to as a passive door and is usually maintained in a closed position with shoot bolts extending from the astragal. The door without the astragal can be referred to as the active door, which is more often opened to allow passage through the entryway. If a single door is present, the single door may be referred to as an active door.

Residents and business owners often rely upon cylindrical or mortise type locks, incorporated within the active door, in order to secure the entryway. In some instances, separate deadbolts are used, in addition to generally centrally located latches, to secure a door panel.

In addition to cylindrical or mortise type locks, builders have found that multipoint locks that have more than one latch or bolt, which are substantially spaced from one another, often provide a more secure closure that is able to seal and secure the entryway better than traditional single-point hardware. Because several latches or bolts are extended or retracted simultaneously, non-trivial effort is sometimes required to operate these multipoint locks.

In addition, smart home technology has begun to interconnect operation of several systems within a home or business. For example, deadbolts for door panels can now be locked or retracted by powered systems based upon an input from a key pad, fob, smart phone, or similar device. Many of the existing powered locks, however, include powered actuation of only a single deadbolt. Prior art powered locks also include substantial packaging placed on the interior or exterior face of the door panel.

SUMMARY

This disclosure relates generally to methods of controlling locks and deadbolts using smart home technology.

Briefly described, the method detailed herein includes setting a mode of a lock with an access controller. The access controller is configured to connect and disconnect at least the external handle associated with the lock from the lock in response to inputs from the lock or a device. For example, the access controller may connect the external handle to the lock in response to the device approaching the lock or in response to an input on the device. The access controller may also detect contact with the external handle to allow unlocking of the lock, prevent unlocking of the lock, or to lock the lock.

In an embodiment of the present disclosure, a method of controlling a lock mechanism of an active door includes transiting an access controller of the lock mechanism to an authorized access mode and transitioning the access controller from the authorized access mode to an entry mode. Transitioning the access controller to the authorized access mode is in response to an authorized user being sensed approaching the active door from an exterior side of the active door or in response to input on a remote device. In the authorized access mode, an exterior handle of the active door is decoupled from a main latch of the lock mechanism. Transitioning the access controller to the entry mode is in response to sensed contact with the exterior handle. In the entry mode, the exterior handle is capable of rotating to transition the access controller to an unlocked mode in which the exterior handle is operably coupled to the main latch and capable of retracting the main latch such that the active door is capable of moving to an open position.

In embodiments, transitioning the access controller to the authorized access mode includes setting the access controller to the authorized access mode for a predetermined access time. The method may include transitioning the access controller to a latch disconnect mode if the access controller remains in the authorized access mode after the predetermined access time. In the latch disconnect mode, the exterior handle remains decoupled from the main latch. The predetermined access time may be in a range of 5 seconds to 30 seconds. Transitioning the access controller to the entry mode may include setting the access controller to the entry mode for a predetermined entry time and transitioning the access controller to the latch disconnect mode if the access controller remains in the entry mode after the predetermined entry time. The predetermined entry time may be in a range of 0.5 seconds to 5 seconds.

In some embodiments, the method includes transitioning the access controller from the entry mode to an unlocked mode in response to the exterior handle being rotated in a first direction form a neutral position. The access controller may switch the lock mechanism to an operating configuration when in the unlocked mode such that the exterior handle is operably coupled to the main latch and capable of retracting the main latch. The active door may be capable of moving to an open position when the main latch is in retracted. The method may include transitioning the access controller form the entry mode or the unlocked mode to a latch disconnect mode such that the exterior handle is decoupled from the main latch in response to the exterior handle being rotated in a second direction opposite the first direction from the neutral position. The method may include the access controller transitioning to the latch disconnect mode in response to extension of the main latch or a deadbolt of the lock mechanism to a deadbolt position.

In certain embodiments, the access controller transitions to the latch disconnect mode in response to direct input on the remote device. Transitioning the access controller of the lock mechanism to the authorized access mode is in response to sensing the remote device approaching the active door from the exterior side of the active door or in response to direct input on the remote device. The remote device may be in operable communication with the access controller.

In particular embodiments, transition the access controller of the lock mechanism to the authorized access mode requires both an authorized user being sensed approaching the active door from the exterior side of the active door and direct input on the remote device.

In another embodiment of the present disclosure, a method of operating a lock mechanism of an active door includes detecting an authorized user approaching an exterior side of the active door or receiving direct input on a remote device such that an access controller of the lock mechanism transition to an authorized access mode, transitioning the access controller to the entry mode such that the exterior handle is operably coupled handle to the main latch, and transitioning the access controller to an unlocked mode in response to movement of the exterior handle of the active door in a first direction from a natural position whether access controller is in the entry mode. In the authorized access mode, the exterior handle is decoupled from a main latch of the lock mechanism such that the exterior handle is prevented from operating the main latch of the lock mechanism. In the unlocked mode of the access controller, the exterior handle is operably coupled to the main latch such that movement of the exterior handle in the first direction retracts the main latch to allow the active door to move to an open position.

In embodiments, transitioning the access controller to the entry mode includes entering a panic/release function in which rotation of the exterior handle in the first direction form a natural position retracts the main latch and rotation of the exterior handle in a second direction from the natural position, opposite the first direction, transitions the access controller to a latch disconnect mode in which the exterior handle is decoupled from the main latch.

In some embodiments, the method includes rotating a deadbolt hub to extend a main latch or a deadbolt to a deadbolt position such that the access controller transitions from the unlocked mode to a latch disconnect mode in which the exterior handle is decoupled form the main latch.

In certain embodiments, the method includes transitioning the access controller from the unlocked mode to a latch disconnect mode in which the exterior bundle is decoupled form the main latch in response to direct input on the remote device. The method may include transitioning the access controller to a latch disconnect mode from the authorized access mode after a predetermined access time in the authorized access mode or from the entry mode after a predetermined entry time in the entry mode.

In another embodiment of the present disclosure, a lock mechanism includes an exterior handle, a main latch, and an access controller, the main latch having a latched position in which the door is prevented from moving from a closed position and a retracted position in which the door is allowed to move from the closed position. The access controller having a first mode in which the main latch is decoupled form the exterior handle and a second mode in which the main latch is operably coupled to the exterior handle such that the exterior handle is configured to actuate the main latch between the latched position and the retracted position.

In embodiments, the access controller is configured to translate a pin between the first mode and the second mode. The pin may couple and decouple the drive hub from the main latch. The access controller may transition from the first mode to the second mode in response to input from a remote device and contact with an exterior handle of the door. The input from the remote device may be proximity of the remote device to the access controller or is direct input on the remote device.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
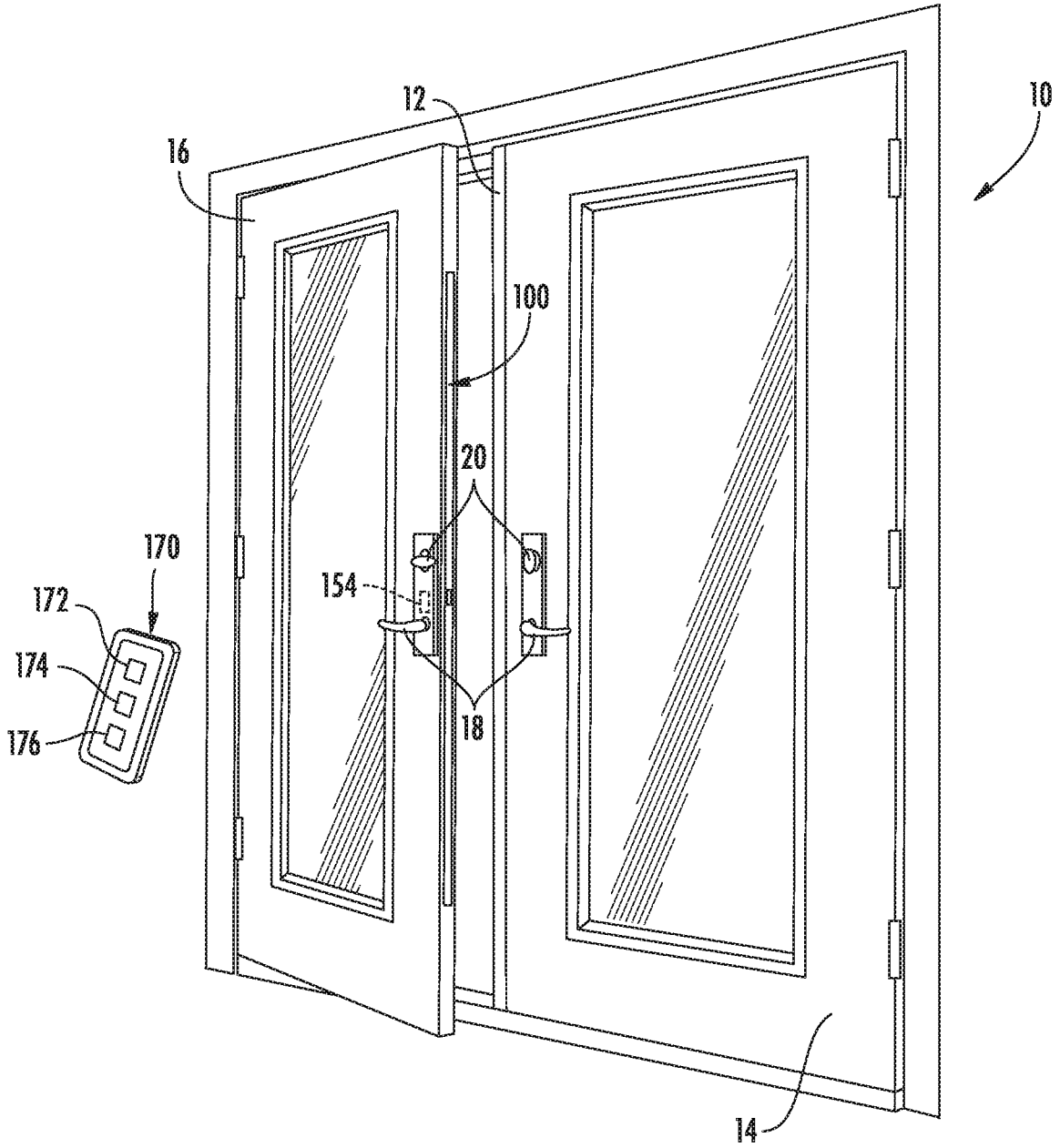
FIG. 1 is a perspective view of an entryway including a lock system provided in accordance with an embodiment of the present disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used herein the term "latch" is defined as a member that slides or pivots into a catch, strike plate, hole, keeper, etc. to fasten or secure a door panel in a closed position relative to the frame of an entryway. The term "latch" as used herein may include structures referred to in the art as latches, latch bolts, and bolts. Latches may or may not be spring loaded unless specifically noted. Latches can extend vertically or horizontally in relation to the door panel of an entryway. As understood by one of ordinary skill in the art, the directions of rotation, relative to a clock, of handles, thumb-turn knobs, and key cylinders can depend upon whether a door panel is mounted for inswing or outswing operation and can be depend upon whether a door is hinged for left hand or right hand operation. Therefore, directional terms such as clockwise and counterclockwise are used in conjunction with their corresponding illustrated embodiment, and alternative mounting arrangements for changing swing or handedness would be understood by one of ordinary skill in the art.

In embodiments, the method described in accordance with the present disclosure may control a multipoint lock configured for mounting onto a non-hinged edge of an active or passive door panel to secure the door panel relative to the frame of an entryway. The multipoint lock may include a thumb-turn knob, an exterior handle lever, and an interior handle lever. The thumb-turn knob may control a deadbolt function of one or more latches and/or a separate deadbolt. The handle levers may operate a single latch or multiple latches. The multipoint lock may also include a powered actuator configured to extend and retract the latch and/or the deadbolt. In addition, the multipoint lock may include an access controller that may disconnect the handle lever from the latch or latches. It will be appreciated that the methods described herein may also be used to control a single point lock with or without a deadbolt.

FIG. 1 illustrates an example of an entryway 10 having double doors with an astragal 12 positioned between the two doors. The door with the astragal 12 can be referred to as a passive door 14 and usually maintained in a closed position with shoot bolts extending from the astragal. The door without the astragal 12 can be referred to as the active door 16, which is more often opened to allow passage through the entryway 10. If a single door is present, the single door may be referred to as an active door; e.g., active door 16.

Figure 2:
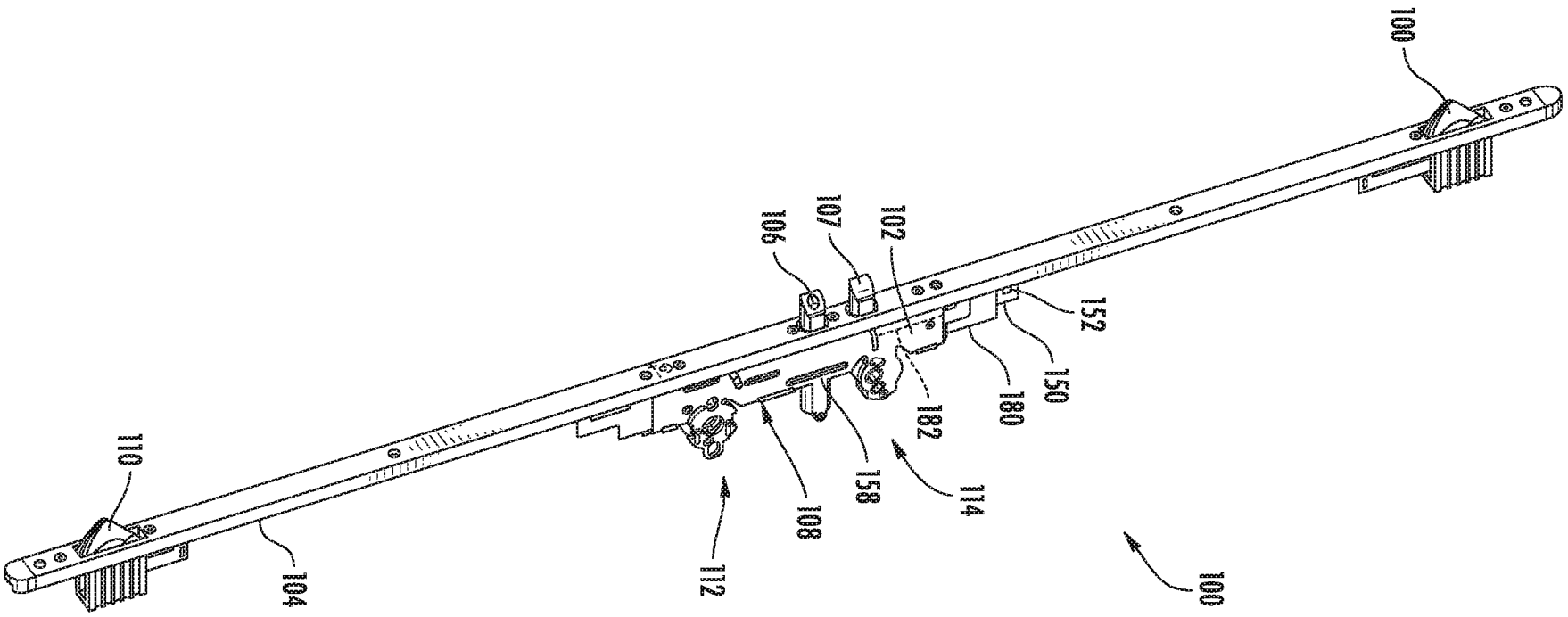
FIG. 2 is a perspective view of a multipoint lock of the lock system of FIG. 1.

FIG. 2 shows a multipoint lock 100 incorporating auxiliary latches 110 and a main or center latch 106. The multipoint lock 100 may also include a deadbolt 107 separate from the center latch 106. The multipoint lock 100 is suitable for mounting into the non-hinged edge of an active door 16 (FIG. 1). The auxiliary latches 110 are configured to extend from the non-hinged vertical edge of the active door 16 into a jamb or a passive door 14 of the entryway 10 (FIG. 1). The auxiliary latches 110 can be of a type that extends and retracts from the non-hinged vertical edge of the active door 16 as shown or alternatively, the auxiliary latches 110 can be shoot bolt types that extend vertically to mate with the header and the threshold.

The multipoint lock 100 has an operating configuration in which the center latch 106 is in a latched position and extends a first latch distance from the edge of the active door 16 and may be retracted to a released position into the edge of the active door 16 by operating an exterior handle lever 18, an interior handle lever (not shown), or by the center latch 106 engaging a strike plate as the active door 16 is closed. In the operating configuration, the auxiliary latches 110 may be in a retracted position within an edge, e.g., a vertical edge, of the active door. In some embodiments, in the operating configuration, auxiliary latches 110 may be movable between a first extended position and the retracted position in response to operating the handle lever 18 or the interior handle lever in a manner similar to the center latch 106. In the first extended position, the auxiliary latches 110 extend a first auxiliary distance from the edge of the active door 16. When the multipoint lock 100 includes the deadbolt 107, the deadbolt 107 is in a retracted position in the operating configuration of the multipoint lock 100.

The multipoint lock 100 also has a locked configuration in which the center latch 106 is in the latched position and is prevented from being retracted to the released position, e.g., prevented from being back driven. In the locked configuration, the auxiliary latches 110 may be in the first extended position and prevented from retracting to the retracted position or may be in the retracted position. In the locked configuration, the handle lever 18 or the interior handle lever may be prevented from rotating or from operating the multipoint lock 100. When the multipoint lock 100 includes the deadbolt 107, the deadbolt 107 is in a retracted position in the locked configuration of the multipoint lock 100.

The multipoint lock 100 also has a fully locked configuration in which the center latch 106 is prevented from retracting to the released position. In the fully locked configuration, the center latch 106 may be in a deadbolt position and extend a second latch distance from the edge of the active door 16 that is greater than the first latch distance. In the fully locked configuration, the handle lever 18 may freely rotate or may be prevented from rotating. In the fully locked configuration, the auxiliary latches 110 may be in the first extended position or may be in a second extended position in which the auxiliary latches 110 extend a second auxiliary distance from the edge of the active door 16 that is greater than the first auxiliary distance. When the multipoint lock 100 includes the deadbolt 107, the deadbolt 107 is in an extended position in the fully locked configuration of the multipoint lock 100 and extends from an edge of the active door 16. In some embodiments, in the fully locked configuration, the deadbolt 107 is in the extended position, the center latch 106 is in the latched position and prevented from retracting, e.g., prevented from being back driven, and the auxiliary latches 110 are in the first extended positions and prevented from retracting, e.g., prevented from being back driven.

The multipoint lock 100 can be operated with the handle lever 18 or the interior handle lever and a thumb-turn knob 20 (FIG. 1) in operable engagement with a mortise box 108 (FIG. 2). As is generally known in the art, the handle lever 18 or the interior handle lever can be biased to a neutral, typically horizontal position. The user can then rotate one of the handle lever 18 or the interior handle lever in a first direction, e.g., downward, or in a second direction opposite the first direction, e.g., upward. Though handle lever 18 is illustrated, knobs may be used in place of one or both of the handle lever 18 or the interior handle lever. In some embodiments, the thumb-turn knob 20 may be replaced by a key cylinder lock set. In addition, the handle lever 18 and the interior handle lever may be independent of one another or can be dependent on one another.

In some embodiments, the multipoint lock 100 includes a powered mechanism 180 that is configured to transition the multipoint lock 100 between the operating configuration, the locked configuration, and the fully locked configuration. The powered mechanism 180 is configured to translate a lock rod 182 to control the configuration of the multipoint lock 100. The powered mechanism 180 may include a linear actuator, a rotary motor, or another mechanism configured to translate the lock rod 182. In some embodiments, the powered mechanism 180 may be back driven by the lock rod 182. For example, the handle lever 18, the interior handle lever, or the thumb-turn knob 20 may translate the lock rod 182 to back drive the powered mechanism 180.

For additional detail on exemplary multipoint locks, reference may be made to U.S. Patent Publication Nos. 2018/0155962 and 2018/0202194, the entire contents of each of these disclosures is hereby incorporated by reference.

The multipoint lock 100 also includes an access controller 150 that is configured to control a mode of the multipoint lock 100. The access controller 150 transitions the multipoint lock 100 between a latch disconnect mode, an authorized access mode, an entry/exit mode, and an unlocked mode. As used herein, the mode of the multipoint lock 100 may be described as a mode of the access controller 150 to improve clarity between modes of the multipoint lock 100 and configurations of the multipoint lock 100 with the modes being control modes and configurations being physical configurations of the multipoint lock 100. The access controller 150 may also be in communication with the powered mechanism 180 to control a configuration of the multipoint lock 100.

The access controller 150 includes a proximity sensor 152 that detects the position or proximity of a user relative to the active door 16. The proximity sensor 152 may detect a device 170 that is on the body of the user to determine the position or proximity of a user. The device 170 may be a fob, a smart phone, a remote, a computer, or another suitable device for interfacing with the access controller 150. More than one device 170 may be associated with the multipoint lock 100. The proximity sensor 152 may differentiate the position or proximity of the device 170 between the device 170 being on an exterior of the active door 16 and the device 170 being on an interior of the active door 16. The proximity of the device 170 to the access controller may be considered input from the device 170.

The access controller 150 may include a pin 158 that is movable, e.g., translatable, within the multipoint lock 100 between a coupled or linked position in which the handle lever 18 is connected to the multipoint lock 100 and a decoupled or delinked position in which the handle lever 18 is disconnected from the multipoint lock 100. The pin 158 may be part of a solenoid, an electromagnetic actuator, or a linear actuator. In some embodiments, the powered mechanism 180 moves the pin 158. In particular embodiments, the pin 158 may also connect and disconnect the interior handle lever from the multipoint lock 100. In certain embodiments, the access controller 150 includes the pin 158 to connect and disconnect the handle lever 18 from the multipoint lock 100 and another pin to connect and disconnect the interior handle lever from the multipoint lock 100 independent of the handle lever 18.

The device 170 may include a first button 172, a second button 174, or a third button 176. The buttons 172, 174, 176 may be physical buttons or may be virtual buttons of an application of the device 170. The functions of one or more of the buttons 172, 174, 176 may be combined into a single button. For example, the first button 172 may transition the access controller 150 to the latch disconnect mode when the access controller 150 is in the unlocked mode and may transition the multipoint lock 100 to the fully locked configuration when the access controller 150 is in the latch disconnect mode.

Figure 3:
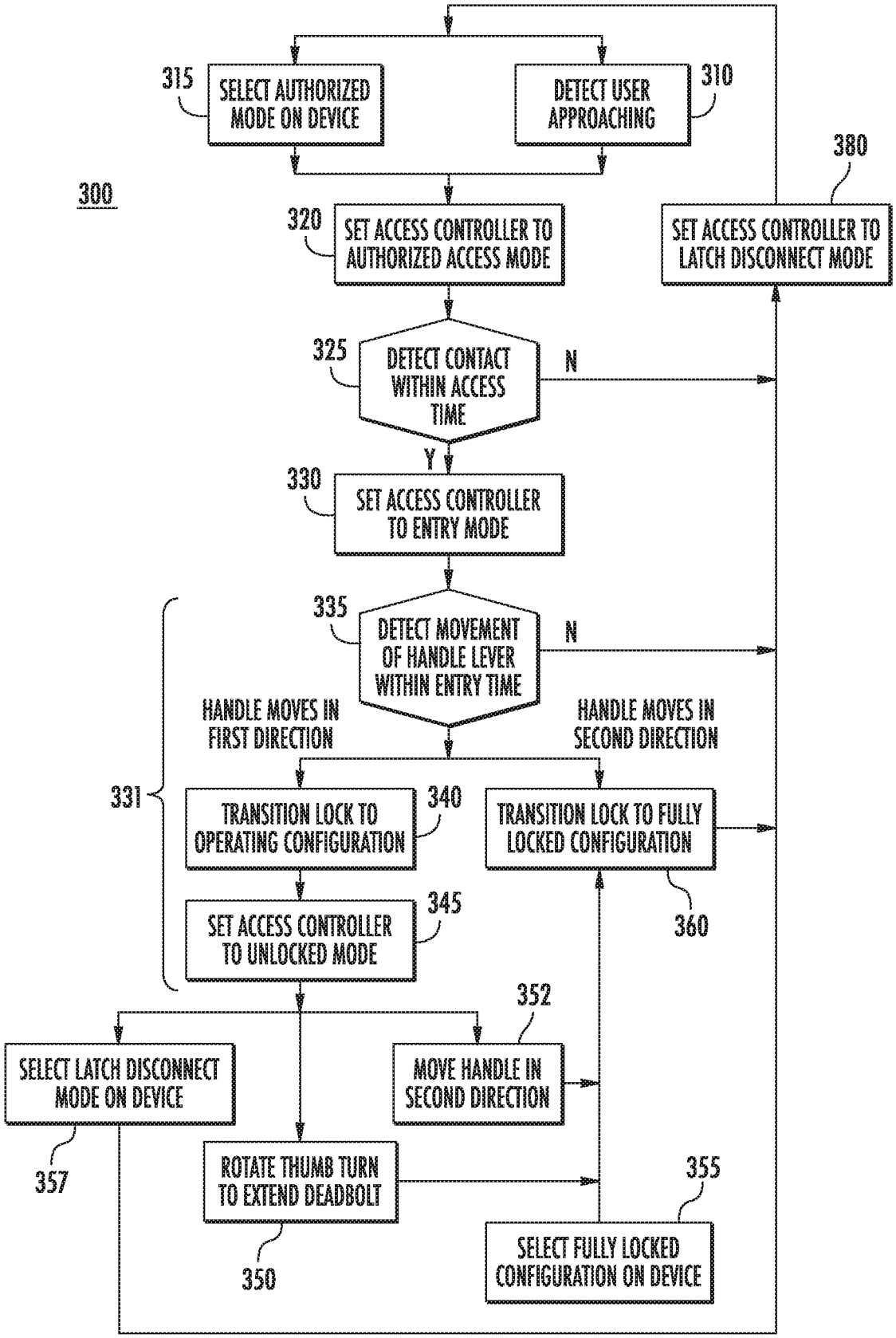
FIG. 3 is a flowchart illustrating a method of operating a lock in accordance with an embodiment of the present disclosure.

With reference to FIG. 3, a method of controlling a lock 300 is detailed with reference to the multipoint lock 100 of FIG. 2. Initially, the multipoint lock 100 may be in any configuration, e.g., the operating, locked, or fully locked configuration, and the access controller 150 is in the latch disconnect mode. In the latch disconnect mode, the pin 158 of the access controller 150 is in a delinked position such that the center latch 106 is disconnected from operation of the handle lever 18. The auxiliary latches 110 and/or deadbolt 107 may also be disconnected from operation of the handle lever 18 in the latch disconnect mode. In the latch disconnect mode, the handle lever 18 may be prevented from rotating from the neutral position or may freely rotate from the neutral position. In certain embodiments, the pin 158 prevents rotation of the handle lever 18 from the neutral position in the latch disconnect mode.

As a user approaches the active door 16 from an exterior side, the proximity sensor 152 detects the device 170 (Step 310). The proximity sensor 152 may sense or detect the device 170 through a Bluetooth® connection, a WiFi connection, a RFID connection, or another suitable connection. When the proximity sensor 152 detects the device 170, the access controller 150 recognizes the user as an authorized user and transitions to the authorized access mode (Step 320). In the authorized access mode, the access controller 150 activates one or more handle sensors 154 (FIG. 1) to detect contact with or a touch of the handle lever 108 from the user (Step 325). Upon contact with the handle lever 18, the access controller 150 transitions the multipoint lock 100 to an entry/exit mode in which the handle lever 18 is reconnected with the multipoint lock 100 (Step 330). Specifically, the access controller 150 may move, e.g., translate the pin 158 to a linked position to reconnect the handle lever 18 with the multipoint lock 100. The access controller 150 may limit the authorized access mode to a predetermined access time after the access controller 150 enters the authorized access mode and before the user contacts the handle lever 18 (Step 325). The predetermined access time may be in a range of 5 seconds to 30 seconds. Additionally or alternatively, the access controller 150 may limit the entry/exit mode to a predetermined entry time after the user contacts the handle lever 18 and before the user moves the handle lever 18 from the neutral position (Step 335). The predetermined entry time may be in a range of 0.5 seconds to 5 seconds. If the user does not contact the handle lever 18 within the predetermined access time or does not move the handle lever 18 within the predetermined entry time, the access controller 150 may revert to the latch disconnect mode (Step 380).

In the entry/exit mode, the access controller 150 may have a panic/release function 331 in which the direction of movement of the handle lever 18 can unlock the multipoint lock 100 or fully lock the multipoint lock 100. For example, in the entry/exit mode movement of the handle lever 18 in the first direction, e.g., downward, transitions the multipoint lock 100 to the operating configuration (Step 340) and transitions the access controller 150 to the unlocked mode (Step 345). Specifically, movement of the handle lever 18 in the first direction is capable of transitioning the multipoint lock 100 from the fully locked configuration to the operating configuration and to move the center latch 106 to the released position and the deadbolt 107 and auxiliary latches 110 to the retracted positions thereof. In the unlocked mode, the access controller 150 allows movement of the handle lever 18 to operate the multipoint lock 100.

When the multipoint lock 100 is in the operating configuration and the access controller 150 is in the unlocked mode, the multipoint lock 100 may be transitioned between the operating configuration and the locked configuration without transitioning the access controller 150 from the unlocked mode. In the unlocked mode, the multipoint lock 100 may be operated by the handle lever 18 or the interior handle lever.

To transition the access controller 150 from the unlocked mode, the thumb turn 20 can be rotated (Step 350) to transition the multipoint lock 100 to the fully locked configuration (Step 360) and to transition the access controller 150 to the latch disconnect mode (Step 380). The thumb turn 20 may be rotated from an interior or an exterior of the active door 16. When the thumb turn 20 is rotated from the exterior of the active door 16, a key cylinder may be used to rotate the thumb turn 20.

In addition, the access controller 150 can be transitioned from the unlocked mode to the latch disconnect mode by selecting a first button 172 on the device 170 (Step 357). When the access controller 150 is transitioned to the latch disconnect mode by the device 170, the multipoint lock 100 may transition to the locked configuration or remain in the operating configuration in response to the access controller 150 transitioning to the latch disconnect mode.

When the access controller 150 is in the latch disconnect mode, the device 170 may include a second button 174 that is configured to transition the access controller 150 into the authorized access mode (Step 315). When in the authorized access mode, contact with the handle lever 18 transitions the access controller 150 to the entry/exit mode as detailed above (Step 330). The device 170 may transition the access controller 150 to the authorized access mode when the device 170 is within the interior of the active door 16. In particular embodiments, the device 170 may transition the access controller 150 to the authorized access mode when the device 170 is entirely remote to the active door 16. For example, the device 170 may be connected to the internet and the access controller 150 may be connected to the internet or an intranet with internet access such that the device 170 may transition the access controller 150 to the authorized access mode. Specifically, the second button 174 can be depressed to transition the access controller 150 to the authorized access mode (Step 315). In the authorized access mode, the access controller 150 can be transitioned to the entry/exit mode as detailed above.

In the entry/exit mode, the panic/release function 331 allows movement of the handle lever 18 in the second direction, e.g., upward, (Step 352) to transition the multipoint lock 100 to the fully locked configuration (Step 360) and transitions the access controller 150 to the latch disconnect mode (Step 380). By allowing movement of the handle lever 18 in the second direction to transition the multipoint lock 100 to the fully locked mode and the access controller 150 to the latch disconnect mode, the multipoint lock 100 can be locked from the exterior of the active door 16 without use of a key. This may be useful when exiting a structure through the active door 16 by allowing a user to confirm that the multipoint lock 100 is locked by moving the handle lever 18 in the second direction from the exterior of the active door 16. In the entry/exit mode, movement of the interior handle lever in the second direction may also be used to transition the multipoint lock 100 to the fully locked configuration and to transition the access controller 150 to the latch disconnect mode.

Utilizing the method 300 above, the access controller 150 may be used for a user to enter through the active door 16 and to secure the active door 16 after entry. For example, when the active door 16 is secured with the multipoint lock 100 in the locked or fully locked configurations or the access controller 150 in the latch disconnect mode, a user may be detected when approaching the door (Step 310), contact the handle lever 18 from the exterior of the active door (Step 325), and move the handle lever 18 in the first direction, e.g., downward, to unlock the multipoint lock 100 and transition the multipoint lock 100 to the unlocked configurations (Step 340). Once inside, the user can choose to leave the multipoint lock 100 in the operating configuration, lock the multipoint lock 100, fully lock the multipoint lock 100, or disconnect the handle lever 18 from operating the multipoint lock 100. The access controller 150 allows the user to transition the multipoint lock 100 to the fully locked configuration or to disconnect the handle lever 18 from operating the multipoint lock 100 by moving the interior handle lever in the second direction, rotating the thumb turn 20, or by using the device 170.

In addition, utilizing the method 300 above, the access controller 150 may be used to allow a guest to enter through the active door 16. Specifically, the user can use the second button 174 to select the authorized access mode on the access controller 150 (Step 315) when the user knows a guest is arriving. The device 170 may allow the user to set a time for the access controller 150 to remain in the authorized access mode or the time may be predetermined. For example, the user may set the time in a range of 1 minute to 2 hours or more. When the guest arrives and contacts the handle lever 18 within the set time (Step 325), the access controller 150 transitions to the entry/exit mode until the guest moves the handle lever 18 (Step 335). The guest may then enter through the active door 16 by moving the handle lever 18 in the first direction. When the guest is inside, the guest can choose to leave the multipoint lock 100 in the operating configuration, lock the multipoint lock 100, or fully lock the multipoint lock 100.

Further, utilizing the method 300 above, the access controller 150 may be used to allow the user, or a guest, to exit and lock the active door 16. Specifically, the user, or guest, may use the interior handle lever to open the active door 16 and exit. When outside, the user, or guest, can close the active door 16 and move the handle lever 18 in the second direction (Step 352) to transition the multipoint lock 360 to the fully locked configuration (Step 360) and to disconnect the handle lever 18 from operation of the multipoint lock (Step 380). This allows the user, or the guest, to secure the active door 16 without requiring a key or the device 170. In addition, the user may utilize the device 170 to disconnect the handle lever 18 from the multipoint lock 100 (Step 357) or to set the multipoint lock in the fully locked configuration (Step 355). The method allows a user, or a guest, to be confident that a door, e.g., active door 16, is secured when exiting by moving the handle lever 18 upward after exiting and closing the door.

In addition, utilizing the method 300 above, the access controller 150 and the device 170 may allow a user to lock the active door 16 when remote to the active door 16. For example, the user can use the third button 176 of the device 170 (Step 355) to transition the lock to the fully locked configuration (Step 360) and to set the access controller 150 to the latch disconnect mode (Step 380). This can be done through a Bluetooth® connection or a local WiFi connection if the user is local to the active door 16 or through an internet connection if the user is remote to the active door 16. In some embodiments, the access controller 150 may provide a status of the access controller 150 or the multipoint lock 100 through the device 170.

While the access controller 150 and the method 300 are detailed above with respect to the multipoint lock 100 and the active door 16, this is not meant to be limiting and the access controller and/or method 300 may be used in conjunction with any suitable locking mechanism for an active door or a passive door.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A method of controlling a lock mechanism of an active door, the method comprising:

transitioning an access controller of the lock mechanism to an authorized access mode in response to an authorized user being sensed approaching the active door from an exterior side of the active door or in response to input on a remote device, in the authorized access mode, an exterior handle of the active door is decoupled within the door from a main latch of the lock mechanism; and transitioning the access controller from the authorized access mode to an entry mode, in the entry mode the exterior handle is capable of rotating to transition the access controller to an unlocked mode in which the exterior handle is operably coupled to the main latch and capable of retracting the main latch of the active door such that the active door is capable of moving to an open position.

2. The method according to claim 1, wherein transitioning the access controller to the authorized access mode includes setting the access controller to the authorized access mode for a predetermined access time, and the method further comprising transitioning the access controller to a latch disconnect mode if the access controller remains in the authorized access mode after the predetermined access time, the exterior handle remaining decoupled from the main latch in the latch disconnect mode of the access controller.

3. The method according to claim 2, wherein the predetermined access time is in a range of 5 seconds to 30 seconds.

4. The method according to claim 1, wherein transitioning the access controller to the entry mode includes setting the access controller to the entry mode for a predetermined entry time, and the method further comprising transitioning the access controller to a latch disconnect mode if the access controller remains in the entry mode after the predetermined entry time, the exterior handle remaining decoupled from the main latch in the latch disconnect mode of the access controller.

5. The method according to claim 4, wherein the predetermined entry time is in a range of 0.5 seconds to 5 seconds.

6. The method according to claim 1, further comprising transitioning the access controller from the entry mode to an unlocked mode in response to the exterior handle being rotated from a neutral position in a first direction, the access controller switching the lock mechanism to an operating configuration when in the unlocked mode such that the exterior handle is operably coupled to the main latch and capable of retracting the main latch, the active door capable of moving to an open position when the main latch is retracted.

7. The method according to claim 6, further comprising transitioning the access controller from the entry mode or the unlocked mode to a latch disconnect mode such that the exterior handle is decoupled from the main latch in response to the exterior handle being rotated in a second direction opposite the first direction from the neutral position.

8. The method according to claim 6, further comprising the access controller transitioning to a latch disconnect mode in response to extension of the main latch or a deadbolt of the lock mechanism to a deadbolt position.

9. The method according to claim 1, further comprising transitioning the access controller to a latch disconnect mode in response to direct input on the remote device.

10. The method according to claim 1, wherein transitioning the access controller of the lock mechanism to the authorized access mode is in response to sensing the remote device approaching the active door from the exterior side of the active door or in response to direct input on the remote device, the remote device in operable communication with the access controller.

11. The method according to claim 1, wherein transitioning the access controller of to the entry mode is in response to sensing contact with the exterior handle when the access controller is in the authorized access mode.

12. A method of operating a lock mechanism of an active door, the method comprising:

detecting an authorized user approaching an exterior side of the active door or receiving direct input on a remote device such that an access controller of the lock mechanism transitions to an authorized access mode, an exterior handle of the lock mechanism being decoupled from a main latch of the lock mechanism in the authorized access mode such that the exterior handle is prevented from operating a main latch of the lock mechanism;

transitioning the access controller to an entry mode such that the exterior handle is operably coupled to the main latch; and transitioning the access controller to an unlocked mode in response to movement of the exterior handle of the active door in a first direction from a neutral position when the access controller is in the entry mode, in the unlocked mode of the access controller, the exterior handle is operably coupled to the main latch such that movement of the exterior handle in the first direction retracts the main latch to allow the active door to move to an open position and movement in a second direction, opposite the first direction, transitions the access controller to a latch disconnect mode in which the exterior handle is decoupled from the main latch.

13. The method according to claim 12, further comprising rotating a deadbolt hub to extend the main latch or a deadbolt to a deadbolt position such that the access controller transitions from the unlocked mode to a latch disconnect mode in which the exterior handle is decoupled from the main latch.

14. The method according to claim 12, further comprising transitioning the access controller from the unlocked mode to a latch disconnect mode in which the exterior handle is decoupled from the main latch in response to direct input on the remote device.

15. The method according to claim 12, further comprising transitioning the access controller to a latch disconnect mode from the authorized access mode after a predetermined access time in the authorized access mode or from the entry mode after a predetermined entry time in the entry mode.

16. A lock mechanism for a door, the lock mechanism comprising:

a drive hub configured to rotate in response to rotation of an exterior handle of the door;

a main latch having a latched position in which the door is prevented from moving from a closed position and a retracted position in which the door is allowed to move from the closed position; and an access controller having a first mode in which the main latch is decoupled from the drive hub and a second mode in which the main latch is operably coupled to the drive hub such that the drive hub is configured to actuate the main latch between the latched position and the retracted position.

17. The lock mechanism according to claim 16, wherein the access controller is configured to translate a pin between the first mode and the second mode.

18. The lock mechanism according to claim 16, wherein the access controller transitions from the first mode to the second mode in response to input from a remote device and contact with an exterior handle of the door.

19. The lock mechanism according to claim 18, wherein the input from the remote device is proximity of the remote device to the access controller or is direct input on the remote device.

20. The method of claim 1, wherein when the access controller is in the authorized access mode the exterior handle is prevented from rotating away from a neutral position.

* * * * *